US005119281A

United States Patent [19]

Akman

[11] Patent Number: 5,119,281

[45] **Date of Patent: * Jun. 2, 1992**

[54] BALLOON LIGHTING DEVICE AND METHOD

[76] Inventor: Alp T. Akman, 1195-A Linda Vista Dr., San Marcos, Calif. 92069

[ * ] Notice: The portion of the term of this patent subsequent to Mar. 5, 2008 has been disclaimed.

[21] Appl. No.: 713,534

[22] Filed: Jun. 5, 1991

Related U.S. Application Data

[63] Continuation of Ser. No. 540,760, Jun. 20, 1990, abandoned, which is a continuation-in-part of Ser. No. 457,108, Dec. 26, 1989, Pat. No. 4,997,403.

[51] Int. Cl.[5] ..... A63H 3/06; F21V 33/60

[52] U.S. Cl. ..... 362/253; 362/806; 446/220; 446/485

[58] Field of Search ..... 362/806, 808, 809, 86, 362/101, 278, 363, 253; 446/220, 221, 222, 223, 224, 225, 226, 485; 40/214

[56] References Cited

U.S. PATENT DOCUMENTS

| | | | |
|---|---|---|---|
| 1,211,369 | 1/1917 | Miller | 446/222 |
| 1,776,182 | 9/1930 | Cook | 362/278 |
| 1,912,960 | 6/1933 | Aki et al. | 362/809 |
| 2,882,645 | 4/1959 | Stivers | 446/222 |
| 2,924,041 | 2/1960 | Jackson et al. | 446/224 |
| 3,536,906 | 10/1970 | Bloom | 362/362 |
| 3,592,157 | 7/1971 | Schwartz | 362/387 |
| 4,542,445 | 9/1985 | Marletta | 362/320 |
| 4,586,910 | 5/1986 | Buchanan | 446/224 |
| 4,924,899 | 5/1990 | Po | 446/222 |
| 4,934,986 | 6/1990 | Wallace | 446/222 |

FOREIGN PATENT DOCUMENTS

| | | | |
|---|---|---|---|
| 2093709 | 9/1982 | United Kingdom | 446/222 |
| 8806474 | 9/1988 | World Int. Prop. O. | 446/222 |

*Primary Examiner*—Richard R. Cole
*Attorney, Agent, or Firm*—Calif Kip Tervo

[57] ABSTRACT

A plug and light stick allow a light bulb to be positioned within a common elastic expandable inflatable balloon having an elastic filler neck. The plug fits into the neck of a balloon and seals against the neck wall. The plug has a central bore having an interior end located within the balloon neck and an outer end. The light stick includes an elongated cylindrical tube having a light bulb on the insertion end. The bore contains therein at least one concentric constriction ring and the tube has an outside diameter such that the tube forms a sliding airtight seal with the constriction ring when inserted in the bore. A pair of electric conductors extend from the bulb, pass along the interior of the tube external the balloon, and connect to an electrical energy source for lighting the balloon. The method involves inserting the plug into the elastic filler neck of the balloon, inflating the balloon by injecting gas through the bore, sealing off the neck interior to the plug, inserting the bulb end, including bulb 35, of the light stick into the exterior end of the plug bore, and positioning the bulb within the balloon as desired.

20 Claims, 3 Drawing Sheets

BALLOON LIGHTING DEVICE AND METHOD

CROSS REFERENCE TO RELATED APPLICATION

This application is a continuation of Ser. No. 590,760 filed Jun. 20, 1990 now abandoned which is a continuation in part of copending parent application NOVEL BALLOON LIGHTING DEVICE, Ser. No. 457,108 filed Dec. 26, 1989 now U.S. Pat. No. 4,997,403.

BACKGROUND OF THE INVENTION

1. Field of the Invention

This invention pertains to the field of and decorative devices. More particularly, it pertains to interiorly lit balloons for use at parties and in decorations where the balloons may be self-supporting or supported on thin, flexible, elongated tubes.

2. Description of the Prior Art

Balloons have long entranced people as a beautiful decoration and a lively entertainment device. Many balloons of different colors may be tied together in various arrangements for decoration purposes. Different sized and shaped balloons are often hung about a party room to brighten the atmosphere. When, however, the exterior lighting becomes dim, such as in the evening on a patio or when the lights are turned low, the loss of illumination reduces the attractiveness of balloons. The prior art has attempted to solve this problem by positioning light bulbs interior of the balloons so that they possess their own light. Unfortunately, such devices are expensive, are difficult to use and in many cases, fail to achieve the desired purpose.

Most of the prior art devices center around light bulb sockets wherein a light bulb is inserted and over which the neck of the balloon is stretched to place the light bulb interior thereof For the most part, these have been unsuccessful because either the seal between the neck and the socket is not sufficiently air tight, thereby allowing the balloon to slowly deflate, or, the heat produced by the light bulb is sufficiently intense to damage the balloon film causing it to burst. In addition, the means by which the sockets have been inserted into the neck of the balloon have been of the type requiring pneumatic sealing materials to be placed thereabout, thereby making the overall device very cumbersome and costly.

This invention is a novel balloon lighting device that achieves the desired purposes of being an easily assembled device that is low-cost and highly efficient in maintaining the required pneumatic seal about the neck of the balloon and at the same time provides the additional feature of allowing the light bulb to be moved freely about the interior of the inflated balloon so as to permit achievement of more decorative and highly fashionable arrangements.

These results are achieved by providing a unique plug or gate-valve for insertion in the neck of the balloon that has a bore formed therethrough containing at least one concentric constriction ring interior thereof for receipt of a hollow tube that will form a slidable yet air-tight seal within the plug. A light bulb, preferably one having an outside diameter less than the diameter of the tube, is pneumatically sealed to one end of the tube and its electric conductors are threaded down through the interior of the tube to extend out the other end. The tube is thereafter slipped inside the bore of the plug and the conductors connected to an energy source to cause the light bulb to light the interior of the inflated balloon. The tube may be slid further into the balloon or withdrawn partially therefrom so as to allow repositioning of the light within the interior of the balloon.

The special plug or gate-valve is made of low-cost plastic and is easily inserted inside the neck of the balloon, either before or after the balloon is inflated. It is insertable in the neck of a deflated balloon to aid the user in inflating the balloon. In one preferred embodiment, a short, hollow stub helps form the bore in the plug to which a pneumatic source, such as helium or compressed air, may be attached with ease to inflate the balloon.

A simple energy source is provided to which the conductor wires are attached and will provide the requisite power at the appropriate voltage and current. Short pieces of hollow tubing containing a pneumatically sealed light bulb may be used in lieu of the elongated tubing thereby allowing the helium-filled balloons to freely bob and weave about tethered to the energy source only by their thin wire conductors so as to provide for even more opportunity to make unique lighted balloon arrangements.

SUMMARY OF THE INVENTION

It is a main object of this invention to provide a low-cost and easily assembled combination of elements to obtain a novel balloon lighting device for use in a wide variety of settings. A further object of the invention is to provide a balloon lighting device capable of having the light bulb repositionable about the interior of the expanded balloon without achieving a loss in balloon air pressure. Further objects include a unique plug for insertion into a balloon that thereafter permits inflation of the balloon without the attendant leakage problems of the prior art. A still further object is to provide a unique plug or gate-valve usable in a wide variety of balloons to permit rapid employment of a light source within the interior of the balloon.

These and other objects of the invention will become more apparent upon reading the following description of the preferred embodiment taken together with the drawings appended hereto The scope of protection sought by the inventor may be gleaned from a fair reading of the claims that conclude this specification.

DESCRIPTION OF THE PREFERRED EMBODIMENT

Figure 2:
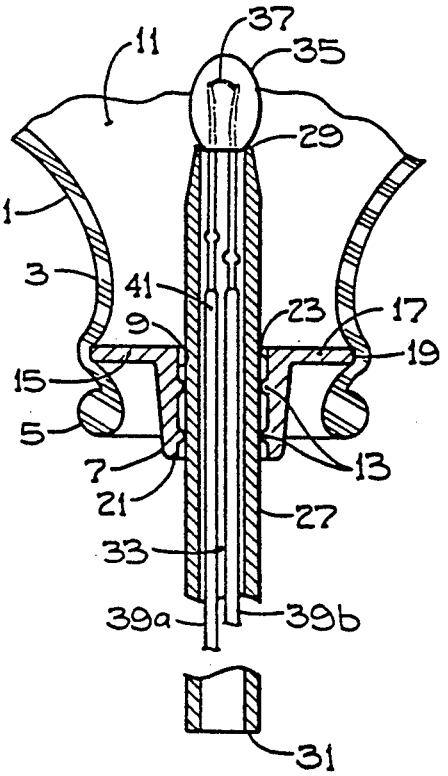
FIG. 2 is a partial cross-sectional view of the plug used in this invention taken along lines 2—2 in FIG. 1.

This invention is useful with common blow-up expandable balloons of all sizes and shapes, the only requirement being that they have a short hollow elastic neck extending therefrom through which air or other expanding gas may pass. As shown in FIG. 2, this invention involves an common inflatable balloon 1 having a single elastic hollow, flexible stub-like neck 3 extending therefrom terminating in a circular thickened end lip 5 surrounding an inflation aperture for acceptance of inflation gas, such as compressed air or compressed helium, to inflate balloon 1. Typically, such a balloon is inflated by holding the neck with fingers of both hands, placing one's lips in sealing engagement with lip 5, and expelling air from the lungs into the balloon 1 through the neck passageway The neck passageway is then sealed off, such as by first squeezing the neck sides together with one's fingers and then more permanently sealed such as by tying a knot in the neck or applying a constricting tie or ring to the neck.

Unique plug or gate-valve 7 is provided adapted for a pneumatically tight fit inside neck 3 and has a bore 9 formed therethrough for access to the interior 11 of said balloon. Bore 9 has an interior end disposed within neck 3 of balloon 1 and an opposite exterior end disposed outside of balloon 1.

Figure 1:
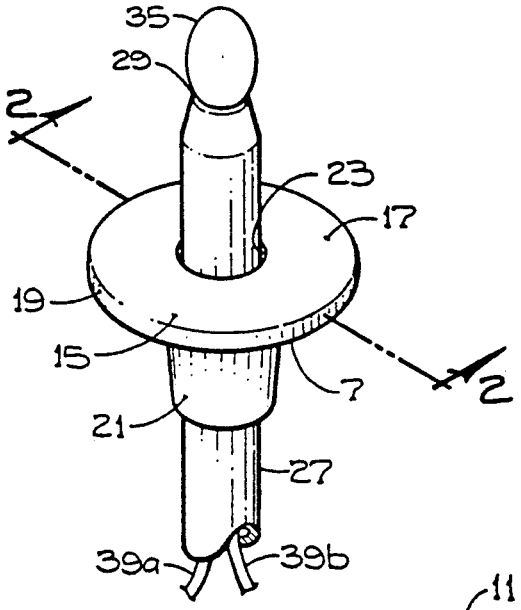
FIG. 1 is a perspective, partially fragmentary view of one of the preferred embodiments of this invention.

At least one and preferably two concentric constriction rings 13 are formed interior of bore 9 for purposes to be hereinafter more fully described. Plug 7 includes a planar member 15 such as a round or circular thin disk 17 as shown in FIGS. 1, 2 and 4 for positioning crosswise or transverse in neck 3. It is important that the outer edge 19 or circumference of planar member 15 be of a size larger than neck 3 so that during transverse positioning therein, neck 3 will stretch over edge 19 so that, in combination with the constriction of end lip 5 will form a pneumatic seal therebetween.

Where planar member 15 is thin, such as in the form of disk 17, bore 9 preferably formed using a short, hollow stub 21 extending outward from an aperture 23 formed through planar member 15 and either attached thereto or formed as a unitary piece as shown in FIGS. 2 and 4. In this configuration, constriction ring or rings 13 are more conveniently placed inside that portion of bore 9 formed inside stub 21 as shown in FIG. 2. Further it is preferable that stub 21 extend outward from aperture 23 perpendicular or normal to planar member 15.

Figure 3:
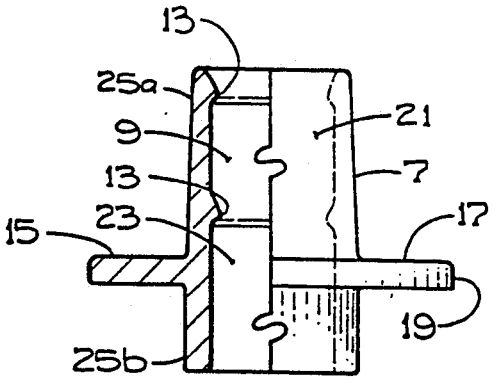
FIG. 3 is a sectional side view of another embodiment of the plug or gate-valve used in this invention; and, FIG. 4*a*–4*d* are perspective views of various configurations of balloons using the plugs, tubes and energy sources of this invention.

Even further preferred is where plug 7 is formed by a pair of short, hollow stubs, 25*a* and 25*b*, held or placed in mutual alignment as shown in FIG. 3, and extending from opposite sides of aperture 23 formed in disk 17 and normal or perpendicular to the plane thereof. It is preferred that aperture 23 be located central in disk 17. In this latter configuration, concentric rings 13 may be formed inside of either stub 25*a*, 25*b* or one or more formed in each one without departing from the scope and spirit of this invention.

A light stick includes an elongated cylindrical member, such as hollow tube 27 having a light source, such as light bulb 35, mounted on an end. Hollow tube 27, having spaced-apart terminal ends 29 and 31 and having a hollow interior 33 formed therein, has an outside diameter of such size as to form a sliding air-tight seal with constriction rings 13 when tube 27 is inserted in plug bore 9. Plug 7 and tube 27 are preferably made of low-cost thermoplastic polymeric material such as polystyrene, polyethylene, polyvinylchloride or combinations thereof as is already known in the art. These materials are specifically adaptable to being injection molded or extruded so that such members may be made in large quantity using high-speed and high-volume forming techniques to reduce their cost.

A light bulb or incandescent lamp 35, preferably of the miniature type such as is found in computers and other devices involving miniature electronics, is mounted in tube terminal end 29 in such as manner as to form a pneumatic seal with tube interior 33 such as with the use of sealant-adhesives such as epoxy, acrylic, or silicone-type adhesives as is already known in the art. These type of bulbs or lamps are known in the art as "sub-miniature" lamps and are obtainable from such sources as WAMCO, INC., 11555 Coley River Circle, Fountain Valley, Calif. 92708. They have a bulb diameter equal to or less than the diameter of tube 27. Lamp 35 generally has positioned therein a fine filament 37 providing light when energized with the proper amount of electric voltage, said filament 37 connected to a pair of fine electric conductor wires 39*a* and 39*b* that extend out from bulb 35 and down into hollow tube interior 33 for passage outside or external balloon 1. Conductors 39 are generally fine copper or copper alloy wires having a coating of insulation 41 thereover and may be as fine as threads.

Usable with this invention is an electrical energy source 43 that may be of a wide variety of types the prerequisite being that it provide the proper voltage of types the prerequisite being that current or alternating current, to energize filament 37 and produce light from light bulb 35.

The method of using the invention to insert a light source into a common elastic inflatable balloon having an elastic filler neck such that the light source is positionable within the inflated balloon comprises the following steps. Typically, plug 7 is inserted into the elastic filler neck 3 of balloon 1 and the balloon is inflated by injecting gas, such as air expelled by a person's lungs, through bore 9 and through neck 3 The filled balloon 1 is sealed off to prevent the filler gas from escaping by sealing neck 3 such as by pinching off, that is by closing off, the neck passageway such as by squeezing the neck sides together with a pair of fingers or by blocking the interior end of bore 9 by holding a portion of the balloon interior neck wall over it. It is also possible to first blow-up, i.e. fill, the balloon, then seal the neck passageway such as by pinching it closed, and then inserting plug 7.

With the neck sealed, the bulb end, including bulb 35, of the light stick is inserted into the exterior end of plug bore 9 so as to totally seal or substantially seal bore 9. Balloon neck 3 is unsealed interior to plug 7 and the light stick is further inserted into bore 9 to place bulb 35 into the interior 11 of balloon 1. The sliding seal formed between light stick tube 27 and constriction ridge 13 allows the light source to be positioned as desired.

Figure 4A:
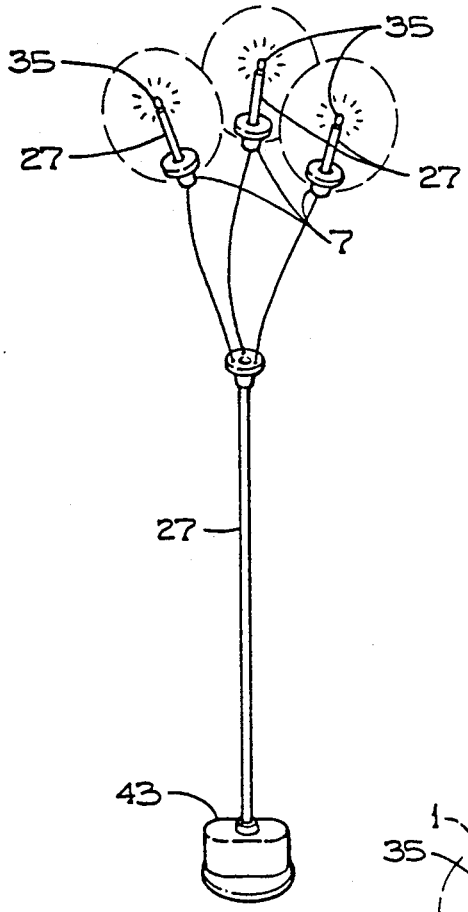
Figure 4B:
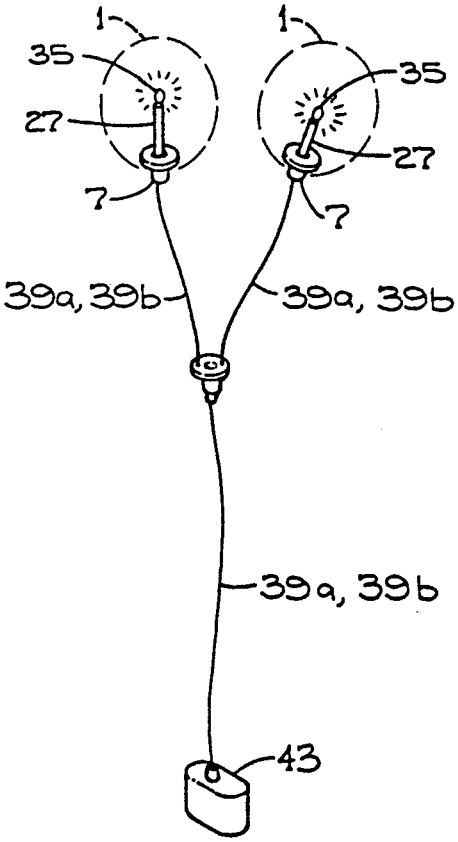
Figure 4C:
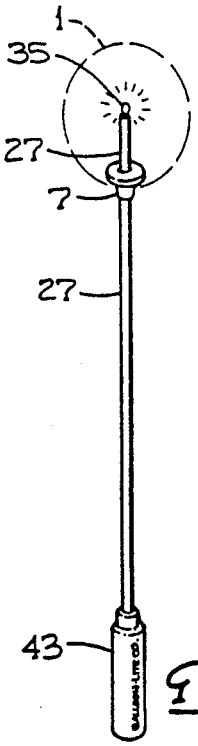

Another form of the invention is shown in FIG. 4*c* where hollow tube 27 is sufficiently rigid enough to support the lighted balloon 1 in spaced-apart relationship above energy source 43. In this configuration, hollow tube 27 is preferred to be of the type having a thin-enough wall to allow it to support the weight of the lighted balloon above energy source 43 but at the same time being sufficiently flexible to allow wind or air from a fan or otherwise oscillate lighted balloon 1 above energy source 43 to provide a colorful and unique decorative arrangement.

In another embodiment, shown in FIG. 46 of this invention, a plurality of balloons 1 are filled with helium gas, each contains a plug 7 in the respective necks 3 and a short length of hollow tube 27 supports light bulb 35 in each balloon. The separate pairs of conductors 39*a* and 396 are attached to a single plug 7 that acts as an anchor point for the balloons while they float above.

In still another embodiment, shown in FIG. 4*a*, a plurality of balloons 1 is attached to common plug 7 and an elongated pair of conductors 39*a* and 396 are used to interconnect common plug 7 to energy source 43 through a single tube 27. In this embodiment, the helium-filled balloons float above energy source 43 tethered thereto by fine wire conductors 39*a* and 39*b*.

Figure 4D:
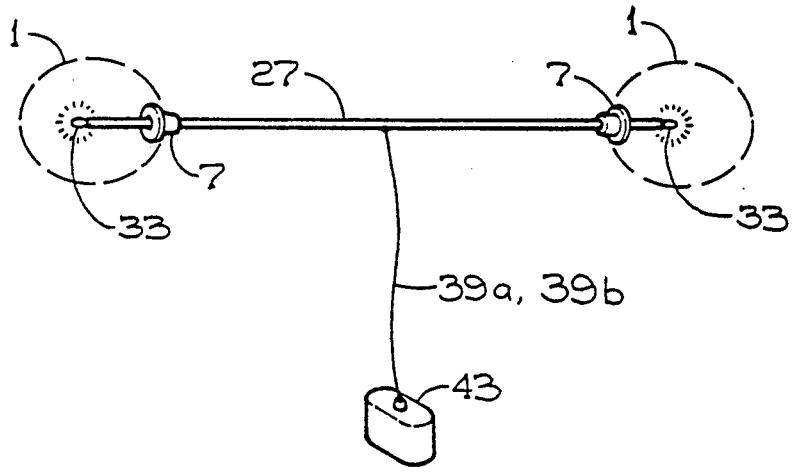

A still further embodiment, shown in FIG. 4*d*, is a pair of balloons 1 attached together through use of a single tube 27 so that they are held in spaced-apart fixed geometry. They may be supported above energy source 43 by filling them with helium or be suspended from above by wires or strings; in all cases they are electrically connected to energy source by conductors 39*a* and 39*b*. More than two balloons 1 may be interconnected by fixing tube 27 in a cross-shape or starshape, etc. and join them at their respective intersections with cutting and gluing as is presently known in the art. In these cases, conductors 39*a* and 396 will be interattached to provide electric energy to each of bulbs 33.

What is claimed is:

1. A balloon lighting device comprising, in combination:

an inflatable balloon having an elastic neck portion and an interior;

a plug adapted for a pneumatically tight-fit inside said neck and having a bore formed therethrough for access to the interior of said balloon;

a hollow tube having an interior and having spaced-apart terminal ends of an outside diameter forming a sliding air-tight seal with said bore when inserted through said bore; and, a light bulb attached to one terminal end of said hollow tube in pneumatic sealing relationship therewith for positioning inside said balloon and including a pair of electric conductors passing from said balloon along the interior of said tube external said balloon.

2. The balloon lighting device of claim 1 further including an electric energy source for connection to said conductors to generate light in said bulb inside said balloon.

3. The balloon light device of claim 9 wherein said hollow tube is elongated and attached to said energy source and of sufficient rigidity to support said balloon spaced above said source.

4. The device of claim 8 wherein said plug bore includes at least one concentric constriction ring interior thereof and said cylindrical member outside diameter forms a sliding seal with said ring.

5. The balloon lighting device of claim 1 wherein said plug includes a planar member having a circumference larger than said neck for transverse positioning in said balloon neck to form a pneumatic seal therebetween.

6. The balloon lighting device of claim 5 wherein said planar member is a thin disk.

7. The balloon lighting device of claim 6 wherein said disk is circular.

8. The balloon lighting device of claim 6 wherein said bore is formed by a short hollow stub extending from an aperture formed in said planar member, normal thereto.

9. The balloon lighting device of claim 6 wherein said bore is formed by a short hollow stub extending from an aperture formed central in said disk, normal thereto.

10. The balloon lighting device of claim 6 wherein said bore is formed by a pair of short hollow stubs in mutual alignment and extending from opposite sides of an aperture formed in said planar member, normal thereto.

11. The balloon lighting device of claim 6 wherein said bore is formed by a pair of short hollow stubs in mutual alignment and extending from opposite sides of an aperture formed in said disk, normal thereto.

12. A device for lighting an interior of an inflatable balloon having an elastic neck portion, comprising:

a plug adapted to form an air-tight seal between said plug and the balloon neck when placed inside the elastic neck of the balloon and having a bore formed therethrough for access to the interior of the attached balloon; said bore including an interior end for disposition inside the balloon neck and an exterior end; and a light stick including:

an elongated cylindrical member having an insertion end and having an outside diameter of such size as to form a sliding air-tight seal with said plug bore;

a light source attached to said insertion end of said cylindrical member; said light source of a size for fitting through said bore; and electrical conductor means within said cylindrical member and contacting said light source for conducting electricity for lighting said light source.

13. The device of claim 12 further including an electric energy source for connection to said conductor means to generate light in said bulb inside said balloon.

14. The device of claim 12 wherein said plug bore includes at least one concentric constriction ring interior thereof and said cylindrical member outside diameter forms a sliding seal with said ring.

15. The device of claim 12 wherein said plug includes a planar member having a circumference larger than the balloon neck for transverse positioning in the balloon neck to form an air-tight seal therebetween.

16. The device of claim 15 wherein said planar member comprises a thin, circular disk.

17. The device of claim 15 wherein said bore is formed by a short, hollow stub extending from an aperture formed in said planar member, normal thereto.

18. The device of claim 15 wherein said bore is formed by a pair of short, hollow stubs in mutual alignment and extending from opposite sides of an aperture formed in said planar member, normal thereto.

19. A method of inserting a light source into an inflatable balloon having an elastic filler neck such that the light source is positionable within the inflated balloon comprises the steps of:

inserting a plug into the elastic filler neck of an inflatable balloon; the plug adapted to form an air-tight seal between the neck of the balloon; the plug having a bore therethrough for access to an interior of the balloon; the bore having an interior end for disposition within the balloon neck and an exterior end;

inflating the balloon by injecting gas through the plug bore;

then sealing the neck such that fluid communication is sealed off between the interior of the inflated and plugged balloon and the interior end of the plug bore;

then inserting a light stick into the exterior end of the plug bore so as to substantially seal the bore; the light stick comprising an elongated cylindrical member having an insertion end and having an outside diameter of such size as to form a sliding air-tight seal with the plug bore and comprising a light source attached to the insertion end of the cylindrical member; the light source of a size for fitting through said bore; and then releasing the neck seal and restoring fluid communication between the balloon interior and the interior plug bore; and then sliding the light stick within the bore so as to place the light source at a desired position within the inflated balloon.

20. The method of claim 19 wherein the inserted light stick includes electrical conductor means within the cylindrical member and contacting said light source for conducting electricity for lighting said light source.

* * * * *